United States Patent [19]

Mainiero

[11] Patent Number: 4,537,133

[45] Date of Patent: Aug. 27, 1985

[54] NON-INCENDIVE ROCK-BREAKING EXPLOSIVE CHARGE

[75] Inventor: Richard J. Mainiero, Pittsburgh, Pa.

[73] Assignee: The United States of America as represented by the Secretary of the Interior, Washington, D.C.

[21] Appl. No.: 480,793

[22] Filed: Mar. 31, 1983

[51] Int. Cl.[3] ..... F42B 3/00

[52] U.S. Cl. ..... 102/316; 102/321; 102/323; 102/331; 102/332; 102/290; 86/20 C; 264/3 R

[58] Field of Search ..... 102/323, 324, 331, 290, 102/275.12, 315–316, 321; 86/20 C; 264/3 R

[56] References Cited

U.S. PATENT DOCUMENTS

| | | | |
|---|---|---|---|
| 1,890,726 | 12/1932 | Farren | 102/24 |
| 2,023,784 | 12/1935 | Farren et al. | 102/324 |
| 2,449,511 | 9/1948 | Russell | 102/331 X |
| 2,499,440 | 3/1950 | Wood | 102/24 |
| 2,635,543 | 4/1953 | Sillitto et al. | 102/24 |
| 2,911,910 | 11/1959 | Welsh, Jr. | 102/324 X |
| 3,472,166 | 10/1969 | Dowling | 102/24 |
| 3,696,703 | 10/1972 | Fox | 86/20 C |
| 3,837,279 | 9/1974 | Cooke, Jr. | 102/24 R |
| 3,881,417 | 5/1975 | Mesia | 102/331 |
| 3,954,701 | 5/1976 | Schaffling | 102/290 X |
| 4,348,955 | 9/1982 | Rowley et al. | 102/331 X |

*Primary Examiner*—Peter A. Nelson

*Attorney, Agent, or Firm*—Thomas Zack; E. Philip Koltos

[57] ABSTRACT

Non-incendive explosive charge for use in flammable atmospheres includes a layer of damp salt as quenching material surrounding a charge enclosed in an inner housing. An outer housing is strong and pliable, being formed of reinforced rubbery material, to resist rough handling yet to be sufficiently pliable to conform to irregular boulder surfaces. The outer housing is pancake-shaped to provide increased contact area and stability. The relatively flat shape further permits insertion of the charge in crevices between boulders.

24 Claims, 2 Drawing Figures

NON-INCENDIVE ROCK-BREAKING EXPLOSIVE CHARGE

BACKGROUND OF THE INVENTION

This invention relates to safety-sheathed explosive charges, and more specifically to rock-breaking, sheathed, charges for breaking or dislodging boulders and loose roof slabs in gassy and dusty mine atmospheres without the danger of ignition of a flammable atmosphere.

BACKGROUND ART

The use of flame inhibitors as sheaths for explosive charges is known in the prior art. A number of flame quenching materials are suggested in the prior art, including sodium chloride, for example.

The resulting charges are typically shaped as unstable cylinders having relatively large height-to-base ratios. Thus, in Wood, U.S. Pat. No. 2,499,440, and Sallitto, U.S. Pat. No. 2,635,543, for example, protective sheaths of specified materials are wrapped about a cylindrical explosive.

The resulting explosive charge is physically unstable for placement on or adjacent irregularly shaped boulders to be blasted or dislodged.

In view of the height-to-base ratio of the cylindrical shapes shown therein, the charge cannot be stably left on its base with assurance that it will neither tip nor topple from that position. Moreover, if left on its cylindrical surface, the charge may roll and thus again be displaced from its desired position. Additionally, the described charges are not readily deformed for providing optimal contact with irregular surfaces of materials to be blasted.

Accordingly, there is a need in the prior art for non-incendive explosive charges having stable physical shapes and moreover being flexible for providing optimal maximal contact with irregular surfaces to be blasted.

SUMMARY OF THE INVENTION

It is an object of the present invention to provide a non-incendive, rock-breaking safety charge for use in gassy and dusty mining environments.

It is a more specific object of the invention to provide a safety charge sheathed in a flame quenching material and having a flexible housing for adapting to irregular shapes of objects to be blasted.

Yet another object of the invention is the provision of a safety-sheathed, non-incendive, charge having a stable physical shape and adaptable for providing maximal contact with materials to be blasted.

Still a more specific object of the invention is the provision of an explosive charge in the form of a short cylinder, the charge surrounded by a layer of flame quenching material and encased in a housing sufficiently strong to resist rough handling and sufficiently pliable to conform to irregular stone surfaces.

Yet a further object of the invention is the use of a cheesecloth-reinforced latex rubber housing to provide a pancake-shaped charge package.

Additional objects, advantages, and other novel features of the invention will be set forth in part in the description which follows and in part will become apparent to those skilled in the art from the following disclosure or may be learned with practice of the invention. The objects and advantages of the invention may be realized and attained by means of the instrumentalities and combinations particularly pointed out in the appended claims.

To achieve the foregoing and other objects, in accordance with the purposes of the present invention as described herein, a non-incendive explosive charge is provided including an explosive means sheathed in a layer of flame quenching material surrounding the explosive means. The explosive means and the flame quenching material are enclosed by a squat housing means. The housing means includes a pair of substantially planar surfaces separated by a transverse peripheral surface. The height of the transverse surface is smaller than the smallest dimension of the planar surfaces.

Preferably, the housing means is formed of a strong pliable material, such as latex rubber reinforced by cheesecloth.

Another feature of the invention provides a detonator well within the housing. Preferably, the detonator well is comprised of a tube means provided on an inner surface of the housing. One such tube may be provided on an inner surface of one of the planar surfaces, and a second such tube may be provided on an inner surface of the transverse peripheral surface. The latex rubber layer is preferably external to the tube means to provide a watertight seal for the explosive.

The housing may further include an inner housing surrounding the explosive and surrounded in turn by the flame quenching material. The inner housing may be formed of a polystyrene material.

In accordance with another aspect of the invention there is provided a housing for an explosive, including an inner housing encasing the explosive and an outer housing surrounding the inner housing and spaced apart therefrom to provide for storage of flame quenching material. The outer housing is formed of a pliable material that has a short, flat shape, including a pair of substantially planar surfaces of substantially identical area separated by a peripheral transverse surface. The transverse surface provides a height to the outer housing which is substantially smaller than a square root of the area of the planar surfaces.

Preferably, the housing means is substantially pancake-shaped for adaptation to various surfaces of items to be blasted and for fitting in narrow spaces intermediate such items.

Yet another aspect of the invention provides a method for making a reinforced latex housing to surround an explosive charge and a detonator. The method includes the steps of forming first and second sections of the housing, each said forming step in turn including the steps of painting a plurality of layers of latex onto an inner surface of a mold. At least one of the forming steps includes a further step of forming a detonator well internally of the housing by placing a tubing section partially in the latex when wet. The latex is dried and peeled from the mold surface.

Preferably, the method includes the further steps of waterproofing the housing by spraying a plastic film on the inner and outer surfaces thereof. The explosive charge is placed within the housing and the first and sections thereof are sealed. Finally, a detonator is inserted into the detonator well formed in the housing by puncturing the latex section external the tube.

Still other objects of the present invention will become readily apparent to those skilled in the art from the following description, wherein there is shown and described a preferred embodiment of the invention simply by way of illustration, and not of limitation, of one of the modes best suited to carry out the invention. As will be realized the invention is capable of still other embodiments, and its several details are capable of modifications in various, obvious aspects without departing from the scope of the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention and, together with the description, serve to explain the principles thereof. In the drawings.

Figure 1:
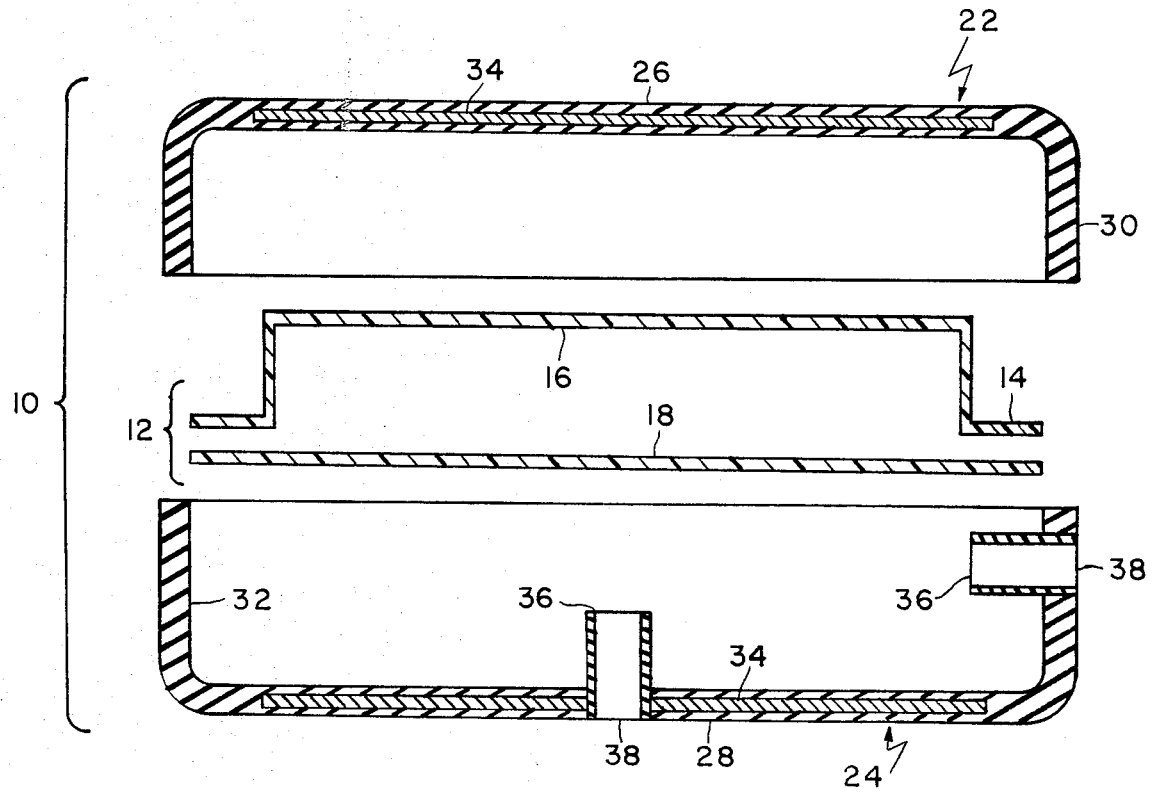
FIG. 1 shows an exploded view of a housing for a non-incendive explosive in accordance with the invention.

Reference will now be made in detail to the presently preferred embodiment of the invention, an example of which is illustrated in the accompanying drawings.

DETAILED DESCRIPTION OF THE INVENTION

As has been described hereinabove, the present invention provides a sheathed charge in a pliable housing and having a shape advantageously devised for rock-breaking use, as well as for dislodging loose roof slabs within gassy or dusty mines.

Although the firing of unconfined explosive charges in mines is presently prohibited due to the hazard of ignition of methane or coal dust, the present invention avoids such a danger and, upon sufficient additional testing and adoption, may lead to revision of the restrictive regulations presently in effect.

The advantages of the present invention are apparent upon reference to the drawings, wherein a housing for a non-incendive explosive charge is generally shown at 10. As seen specifically in FIG. 1, the inventive housing includes an inner housing 12 for an explosive. Preferably, inner housing 12 is formed of a polystyrene material, although cardboard or other materials may be used therefor. The inner housing is shaped to accept the desired quantity of charge. As described in the sequel, a number of experiments were conducted on charges of 1.5 lbs. of a water gel explosive in the form of a short cylinder, shaped by inner housing 12 to be approximately 7 inches in diameter and $\frac{7}{8}$ inches high and surrounded by a layer of flame quenching material. The charge, equivalent to two 1.25 by 16 inch cartridges of the explosive, was experimentally found to be adequately protected for safe open firing in a flammable atmosphere when surrounded by a layer of salt which dispersed as a fine cloud upon firing. For the dimensions and quantities of explosive described, a 0.5 inch layer of salt proved adequate. The inventive housing includes a spacing flange 14, formed about the inner housing 12 for separating the inner and outer housings to permit placement of the flame quenching material therebetween.

The inner housing 12 is formed as a combination of two sections 16 and 18, providing an appropriately sized container for the desired quantity of explosive. For ease in manufacturing and sealing the housing, section 18 is formed as a planar circular disk, while section 16 of the inner housing is formed to provide a short cylindrical shape to the explosive charge.

An outer housing 20 is preferably formed of two substantially identical sections 22 and 24. Each section includes a substantially open cylindrical shape, the two sections being sealed to provide a squat cylindrical shape to the charge. As seen in the drawing, sections 22 and 24 include substantially planar sections 26 and 28, respectively. Depending portions 30 and 32 extend from the planar sections 26 and 28, respectively, to provide a height dimension to the resulting outer housing. Preferably, the outer housing height is sufficiently small to provide the overall package with a substantially pancake-like appearance.

The dimensions of outer housing 20 are chosen to provide sufficient volume for the inner housing 12 and for a sufficient quantity of flame quenching material. For a charge of 1.5 lbs. of water gel explosive, a 0.5 inch layer of damp salt mixture, comprising 88% sodium chloride and 12% water, provides the desired flame inhibition. Accordingly, flange 14 is preferably provided a 0.5 inch dimension, thereby acting as a spacer between inner housing 12 and outer housing 20, for ease in assembly. Housing 20 is thus provided a short cylindrical shape, having a 4 inch radius and a 2 inch height.

As further illustrated in the exploded view of FIG. 1, outer housing 20 includes a reinforcement layer 34 to provide additional strength to the housing. As is further illustrated in the drawings, one or more detonating wells 36 may be provided within the outer housing 20. Preferably, detonating wells 36 are formed of tubes extending from outer housing 20 in the direction of inner housing 12, the tubes advantageously providing additional spacers for placement of inner housing 12 within outer housing 20.

Preferably, outer housing 20 is formed of a latex rubber, reinforced by layer 34 formed of a cheesecloth material. Detonating wells 36 are preferably rubber tubes serving as guides for insertion of detonators therein.

The resulting outer housing is thus pliable and provides a large surface area at planar sections 26 and 28 thereof for contacting the boulders or other items to be blasted. The pliable nature of the housing permits the charge to be molded to provide maximal contact with the boulders, the increased contact area further serving to increase stability of the explosive when positioned against the boulders.

Providing the charge with a pancake-like shape, or similar squat shape having large contact areas and small transverse distances, permits the charge to be inserted in crevices between boulders, or in other similar locations wherein a bulky explosive might not fit.

Of course, although a cylindrical shape has been described for the housing, it is understood that any flattened shape may be useful. The specific planar shape of sections 26 and 28, in other words, need not be circular. Preferably, however, the height dimension provided by depending portions 30 and 32 is smaller than the smallest width dimension of the planar sections in order to provide the advantages of increased stability available in the pancake or squat, flattened, shape to the housing. Thus, for example, if the sections 26 and 28 are rectangular, the height of depending portions 30 and 32 should be smaller than the shorter dimension of the rectangular shape of the sections. For circular shaped sections 26 and 28, the height should be substantially less than the diameter thereof, providing a 2 inch height for the present 8 inch diameter, for example. A similar pancake shape may be attained for sections having other polygon shapes by maintaining the height substantially less than the square root of the area of sections 26 and 28.

A further advantage of the inventive housing and material used therefor is the ease of manufacture. Thus, for example, the present housing may be formed by painting layers of a liquid latex rubber onto the inner surface of a hollow mold. The dry rubber housing may then be peeled from the inner surface of the mold. Where detonator wells are desired, appropriately dimensioned sections of rubber tubing may be placed in the wet latex in order to embed the wells therein. By only partially penetrating the wet latex with the tubes, a film 38 remains in the outer housing for covering the opening to the detonating wells. Thus, placement and insertion of the detonators is easily enabled by puncturing film 38 at the appropriate well or wells.

Additionally, in view of the preferred fire quenching material, specifically damp salt, the inventive housing is advantageously made watertight in order to prevent the charge from drying out. The housing is waterproofed by spraying both inner and outer surfaces of the outer housing with a thin plastic film.

While dry salt may be used, thus avoiding the requirement for waterproofing the housing, experiments performed on various charges indicate that when dry salt is used for fire quenching the salt packs into a solid mass. The salt mass cannot deform to fit an irregular stone surface, thus undoing one of the advantages of the present invention.

For situations not requiring waterproofing of the housing, the two rubber sections may be bonded to one another or otherwise attached by any known method. Similarly, the two sections of the inner housing for the explosive charge, preferably formed from high-impact styrene using, for example, a vacuum forming apparatus, are securely cemented prior to combination with the flame quenching material and the outer housing.

In operation, upon firing the charge (against a rock, for example, with a detonator) the sodium chloride and water mixture, or its equivalent, is dispersed as a fine cloud. The dispersed material prevents ignition of a flammable atmosphere while shock from the detonation shatters the rock. As previously described, the rubber housing enables transfer of maximum impact to the rock by conforming to the irregular surfaces thereof to provide improved contact between the charge and the rock. The reinforced housing additionally is strong enough to withstand rough handling, and is pliable enough to provide the desired conformity to the rock surfaces.

Figure 2:
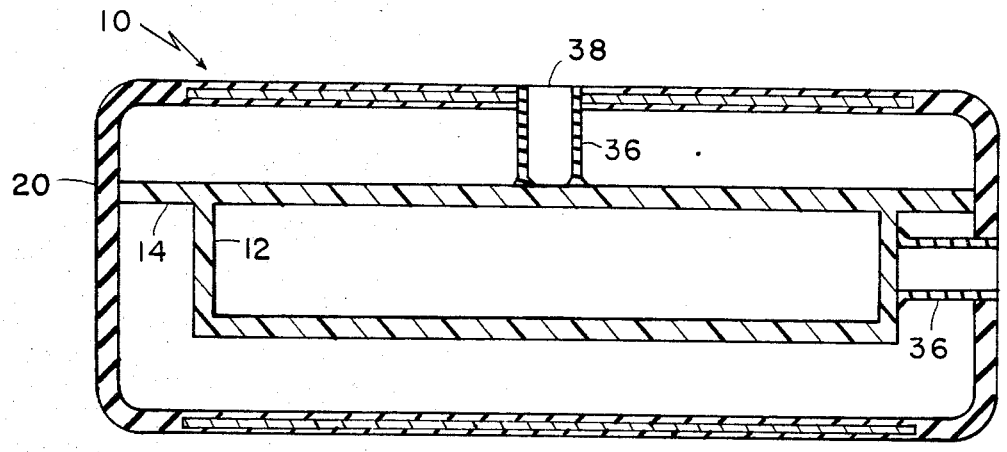
FIG. 2 shows a view of the assembled housing.

A number of non-incendive charges in accordance with the invention were tested to determine whether such charges could be fired safely in flammable atmospheres, and moreover to determine the rock-breaking capability of the appropriately housed charges. As previously described, the experimental explosive package included a 1.5 lb water gel charge surrounded by a 0.5 inch layer of damp salt and enclosed in a housing as shown in FIG. 2. A short cylinder having a diameter of 8 inches and a height of 2 inches was used to encase the charge.

1. Gassy Atmosphere

Incendivity testing was conducted in a "bombproof" bunker using a steel and plastic gallery 6 feet wide, 6 feet tall, and 8 feet long. Inside the gallery a 3×3×1 foot concrete block that served as a simulated boulder was set on edge, and the charge was taped to one of the vertical faces. Methane was added to the gallery, and the gas-air atmosphere was constantly mixed with a circulating fan and monitored with an infrared analyzer. When the gallery atmosphere stabilized at 9% methane, a sample was taken for analysis, the mixing and sampling apparatus were shut down, and the charge was fired with a No. 6 instantaneous detonator. Ignition of the methane could be identified by the intense noise and vibration, which did not accompany nonignitions.

Ten of the prototype charges were tested for incendivity in the manner described above. All charges satisfactorily broke the concrete block without causing ignition.

2. Gassy/Dusty Atmosphere

Tests to evaluate the sheathed rock-breaker's incendive characteristics in a flammable gassy/dusty atmosphere were conducted in a manner similar to that described above. For this series of tests, the flammable gallery atmosphere consisted of 2 oz/cubic ft of coal dust predispersed in a gas mixture of 4.5% methane and 95.5% air. The coal dust was spread over a length of 30 grain/ft detonating cord situated in an 8 foot long V-shaped trough made from 5×5 inch angle steel mounted 7 inches above the floor of the gallery. The detonating cord was initiated 0.5 second prior to initiation of the explosive charge. This method of dust dispersal distributes the coal dust uniformly in the gallery without igniting it.

Ten of the sheathed rock-breaker charges were fired in the flammable methane-coal dust-air atmosphere with no ignition. For comparison, a bare 1.5 lb charge was similarly tested, resulting in a violent ignition which could be easily distinguished from the nonignitions.

3. Fumes Tests

Testing was conducted to determine whether the fired sheathed rock-breaker charges produced significant volumes of toxic fumes. The tests were conducted in a toxic fumes chamber comprising a steel tank 7 feet in diameter and 37 feet long, with 0.75 inch thick walls. The chamber can be completely sealed so that the fumes produced by the detonation of an explosive charge remain contained within it and can be analyzed using standard techniques.

Three sheathed rock-breaker charges were tested in the toxic fumes chamber. For two of the shots the gaseous detonation products were analyzed for carbon monoxide and the oxides of nitrogen. The third shot was conducted to determine whether any toxic phosgene gas was produced. A Drager pump and phosgene detector tube were used for this test. The charges produced an average of 0.18 cubic feet of poisonous gases (CO, NO, and $NO_2$) per pound of explosive. This is well below the limit of 2.5 cubic feet per pound approval criterion specified in 30 C.F.R. 15.12. The search for phosgene gas proved negative. The concentration of phosgene was thus below the detectable limit of one part per billion.

4. Rock-breaking Tests

A series of tests was conducted to determine how well the prototype sheathed charge would break boulders. For these tests, limestone boulders were selectively chosen from among many scattered across the grounds of an abandoned limestone quarry. To begin the tests, two boulders were chosen that were approximately the same size as the concrete blocks broken in the incendivity tests.

Test 1: The boulder used in the first test was 54 inches wide, 32 inches high, and 18 inches thick, with an estimated weight of 2,700 lbs. It was placed on edge with the charge firmly taped against the side. In all of the tests the charge was positioned on a fairly smooth and flat surface of the boulder, perpendicular to the shortest dimension. An instantaneous detonator was used to fire the charge. The charge performed very well, breaking the boulder into pieces that could be conveniently handled. In addition, the firing of the charge did not produce any detectable flyrock.

Test 2: The boulder chosen for the second test was similar in shape to that used in the first test but was a little smaller (48×22×19 inches, 1,900 lbs.) and was placed flat rather than on edge.

Since the charger was placed atop the boulder, no tape was necessary to hold it in place. The charge again broke up the boulder well. One large piece remained, but it had so many cracks in it that one below with a sledge hammer would have shattered it.

Test 3: Because the nonincendive charge had performed so well in Tests 1 and 2, it was next tested on a much larger boulder (60×80×48 inches, 20,000 lbs.) The charge was not able to shatter the boulder. However, the charge did produce many cracks in the boulder and widened the cracks that were present initially. It appeared that firing another charge against the boulder would have shattered it.

Test 4: Test 4 was conducted to determine whether two of the nonincendive charges fired simultaneously could satisfactorily break a very large boulder similar to that in Test 3. The boulder chosen was 91 inches long, 74 inches wide, and 44 inches thick with an estimated weight of 25,000 pounds. The two charges, placed several feet apart on two flat faces, were fired simultaneously. The boulder was broken into several large pieces and many smaller pieces. The larger pieces were too large for convenient manual handling, but inspection revealed that they were cracked to such an extent that it would have been a simple matter to break them with a sledge hammer.

As noted for the incendivity tests, no significant flying debris was observed in any of the four tests.

5. In-Mine Tests

Following verification of the sheathed rock-breaker charge's safety and effectiveness, field trials were conducted in an underground bituminous coal mine in southeastern Ohio. The situations for testing of the charge were selected by mine personnel as typical of those they found to be the most hazardous or difficult to deal with.

The first series of tests involved a pile of stone slabs on the floor and a loose roof slab which were the result of a roof fall.

In the first test, one charge was placed on a stone slab measuring approximately 54 inches long, 32 inches wide, and 18 inches thick. The charge broke the stone slab quite effectively. All of the resulting fragments could easily be moved by one person. For this and later tests, no significant flyrock was observed.

For the next test, three charges were used to break three stone slabs (each measuring approximately 5×4×2 ft.) located at the site of the roof fall. In this multiple shot as well as subsequent ones, the sheathed rock-breaker charges were fired simultaneously with instantaneous No. 6 detonators.

At the location of the first tests, a large stone slab measuring approximately 10 feet long, 3 feet wide and 1 foot thick was hanging precariously from the roof. Normally, two charges should have been used to bring down a roof slab of this size, but this was not possible because one end of the slab extended into an area of bad roof. Therefore, one charge was placed at one end in the crevice between the roof and the hanging slab. The charge brought down half of the roof slab quite effectively. The next step would thus be to clear away the rubble, install roof bolts, and use another charge to bring down the rest of the loose roof slab.

The next test was conducted in another area of the mine. Here, the problem was similar to that previously encountered. Large slabs of stone had fallen from the roof and rib. In this case, the stone had remained relatively intact consisting of two large slabs measuring 15×3×3 ft and 20×4×2 ft. Both slabs were broken with multiple charge shots; three sheathed rock-breaker charges propped against the side of the 15 foot slab and five sheathed rock-breaker charges placed atop the 20 foot slab.

One of the hazards encountered in an underground coal mine is the hanging brow. In such a configuration, one of the sheathed charges was wedged into a crevice between the rib and the hanging stone. The charge effectively broke the stone, eliminating the hazardous condition.

As a result of the foregoing experiments, other applications for the sheathed charge are possible. One such application is the removal of a crib. This is normally a hazardous and difficult operation, but two charges fired within one such crib removed it safely and easily. Another suggested use, which was not tested, is the removal of mud and water from a sump. There are undoubtedly more novel applications of the sheathed charge.

Testing of the sheathed rock-breaker suggests that it is both safe and effective. The charge will not ignite a flammable methane-air or dusty atmosphere and is capable of breaking boulders weighing up to two tons into pieces which can be handled by one person. For boulders weighing up to ten tons, several of the charges fired simultaneously would be effective. The charges were also found to be safe relative to flyrock.

There has thus been described, in accordance with the invention, a non-incendive charge enclosed in a pliable yet strong housing.

The foregoing description of the preferred embodiment of the invention has been presented for purposes of illustration and description, and is not intended to be exhaustive or to limit the invention to the precise form disclosed. Obvious modifications or variations are possible in light of the above teachings. For example, different size charges may be provided in different size housing for application to different boulders or other targets. Similarly, other proportions of salt and water may be used as a flame quenching agent, as may water, a gelled saltwater solution, or any powdered agent. Further, other rubberlike materials may be better suited to mass production methods than the latex rubber reinforced with cheesecloth, as hereinabove described. The inner housing may be formed of cardboard or other materials rather than the polystyrene material described. It is further possible that the flame quenching agent may be omitted from the surface of the explosive contacting the boulder. Additionally, the inner housing may be differently formed, specifically including the spacing flange at its midsection by forming two substantially identical shortened cylindrical portions, each portion having a flange for mating with the other and for spacing the resultant inner housing from the outer housing. Alternatively, two semicylindrical portions may be formed, each including a flange for mating with the other.

The described embodiment was chosen to provide the best illustration of the principles of the invention and a practical application thereof, thereby to enable one of ordinary skill in theart to utilize the invention in various other embodiments and with various modifications as are suited to the particular use contemplated. It is intended that the scope of the invention be defined by the claims appended hereto.

I claim:

1. A non-incendive explosives charge comprising:

explosive means sheathed in a layer of flame quenching material surrounding said explosive means; and squat housing means formed of a rubbery material enclosing said explosive means and said flame quenching material, said housing means having a pair of substantially planar surfaces separated by a transverse peripheral surface having a height smaller than the smallest dimension of said planar surfaces.

2. Non-incendive explosive charge as recited in claim 1 wherein said rubbery material comprises reinforced latex rubber.

3. Non-incendive explosive charge as recited in claim 2 wherein said latex rubber is reinforced by cheesecloth.

4. A non-incendive explosives charge comprising:

explosive means sheathed in a layer of flame quenching material surrounding said explosive means;

squat housing means enclosing said explosive means and said flame quenching material, said housing means having a pair of substantially planar surfaces separated by a transverse peripheral surface having a height smaller than the smallest dimension of said planar surfaces; and detonator well means in said housing means.

5. Non-incendive explosive charge as recited in claim 4 wherein said detonator well means comprises tube means on an inner surface of said housing means.

6. Non-incendive explosive charge as recited in claim 5 wherein said detonator well means comprises first tube means on an inner surface of one of said planar surfaces.

7. Non-incendive explosive charge as recited in claim 6 wherein said detonator well means further comprises second tube means on an inner surface of said transverse peripheral surface.

8. Non-incendive explosive charge as recited in claim 7 wherein said housing means includes a latex rubber layer external to said first and second tube means for providing a watertight seal for said explosive means.

9. Non-incendive explosive charge as recited in claim 1 wherein said housing means is formed of a flexible material and includes an inner housing surrounding said explosive means, said flame quenching material surrounding said inner housing, said pair of planar surfaces and said peripheral surfaces surrounding said flame quenching material.

10. Non-incendive explosive charge as recited in claim 9 further comprising detonator well means for housing a detonator and extending from at least one of said pair of planar surfaces and said peripheral surface toward said inner housing, said detonator well means enclosed by a puncturable layer of said flexible material.

11. Non-incendive explosive charge as recited in claim 9 wherein said inner housing further comprises a spacing flange for spacing said inner housing inwardly from said outer housing thereby to permit a predetermined quantity of said flame quenching material to be inserted therebetween.

12. Housing means for an explosive comprising:

inner housing means enclosing said explosive; outer housing means surrounding said inner housing means and spaced apart therefrom to provide for storage of flame quenching means therebetween, said outer housing being formed of a pliable reinforced latex material and being short substantially flat shaped including a pair of substantially planar surfaces having substantially identical areas and separated by a peripheral transverse surface providing a height dimension to said outer housing means which is substantially smaller than the square root of the area of said planar surfaces.

13. Housing means as recited in claim 12 wherein said inner housing means is formed of a polystyrene material, and further comprising detonator well means extending from said outer housing means.

14. Housing means for an explosive comprising:

inner housing means enclosing said explosive; outer housing means surrounding said inner housing means and spaced apart therefrom to provide for storage of flame quenching means therebetween, said outer housing being formed of a pliable reinforced latex material and being short substantially flat shaped including a pair of substantially planar surfaces having substantially identical areas and separated by a peripheral transverse surface providing a height dimension to said outer housing means which is substantially smaller than the square root of the area of said planar surfaces.

15. A method for making a reinforced latex housing to surround an explosive charge and a detonator comprising the steps of:

(a) forming a first section of said housing, said forming step including the steps of painting a plurality of layers of latex onto an inner surface of a mold;

forming a detonator well internally of the housing by placing a tubing section partially in the latex when wet;

drying the latex; and peeling the latex from the mold surface;

(b) forming a second section of said housing;

said second forming step including the steps of painting a plurality of layers of latex onto an inner surface of a mold;

drying the latex; and peeling the latex from the mold surface;

(c) enclosing said explosive charge within said housing;

(d) surrounding said explosive charge with a flame quenching material; and (e) sealing said first and second sections.

16. A method as recited in claim 15 further comprising the step of waterproofing said housing by spraying plastic film on inner and outer surfaces thereof.

17. Housing means as recited in claim 14 wherein said inner housing means is formed of a rigid material for provding a short cylindrical shape to the outer housing means.

18. Housing means as recited in claim 14 wherein said inner housing means comprises first and second sections, said first section formed as a planar disk, said second section formed as a short cylindrical structure.

19. Housing means as recited in claim 18 wherein:

said spacer means comprises a flange formed by peripheral areas of said first and second sections of said inner housing means.

20. Housing means as recited in claim 14 wherein said outer housing means comprises first and second separate, substantially identically shaped, sections of a reinforced latex material.

21. Housing means as recited in claim 20 wherein said first and second sections each includes therein a reinforcing cheesecloth layer.

22. Non-incendive explosive charges recited in claim 8 wherein said layer of latex rubber external to the tube means is sufficiently thin to be penetrable for insertion of a detonator charge in said tube means.

23. A method as recited in claim 15, at least one of said first and second forming steps including the step of reinforcing said first or second section of said housing by including a reinforcing layer therein.

24. The method recited in claim 23 wherein said reinforcing step comprises the step of including a layer of cheesecloth intermediate said plurality of layers of latex painted onto the inner surface of the mold.

* * * * *